United States Patent [19]

Möllenhoff

[11] 4,118,684

[45] Oct. 3, 1978

[54] ONE PIECE FUSIBLE CONDUCTOR FOR LOW VOLTAGE FUSES

[75] Inventor: Klaus Möllenhoff, Regensburg, Fed. Rep. of Germany

[73] Assignee: Siemens Aktiengesellschaft, Berlin and Munich, Fed. Rep. of Germany

[21] Appl. No.: 775,439

[22] Filed: Mar. 8, 1977

[30] Foreign Application Priority Data

Mar. 11, 1976 [DE] Fed. Rep. of Germany ..... 2610262

[51] Int. Cl.[2] ..... H01H 85/10

[52] U.S. Cl. ..... 337/296; 337/160; 337/295

[58] Field of Search ..... 337/160, 296, 163, 166, 337/164, 295, 293, 161

[56] References Cited

U.S. PATENT DOCUMENTS

| | | | |
|---|---|---|---|
| 2,734,111 | 2/1956 | Kozacka | 337/161 |
| 2,773,961 | 12/1956 | Sundt | 337/163 |
| 3,835,431 | 9/1974 | Rosen et al. | 337/160 |

FOREIGN PATENT DOCUMENTS

| | | | |
|---|---|---|---|
| 997,227 | 7/1965 | United Kingdom | 337/295 |

*Primary Examiner*—Harold Broome

*Attorney, Agent, or Firm*—Kenyon & Kenyon, Reilly, Carr & Chapin

[57] ABSTRACT

In a one piece fusible conductor of the type having cutouts for narrowing the path of current so as to form current carrying isthmuses with a hole filled with a solder deposit adjacent each isthmus, the cross section at each isthmus has a definite relation to the cross section of the material between the hole containing the solder deposit and the diamond shaped cutouts.

2 Claims, 1 Drawing Figure

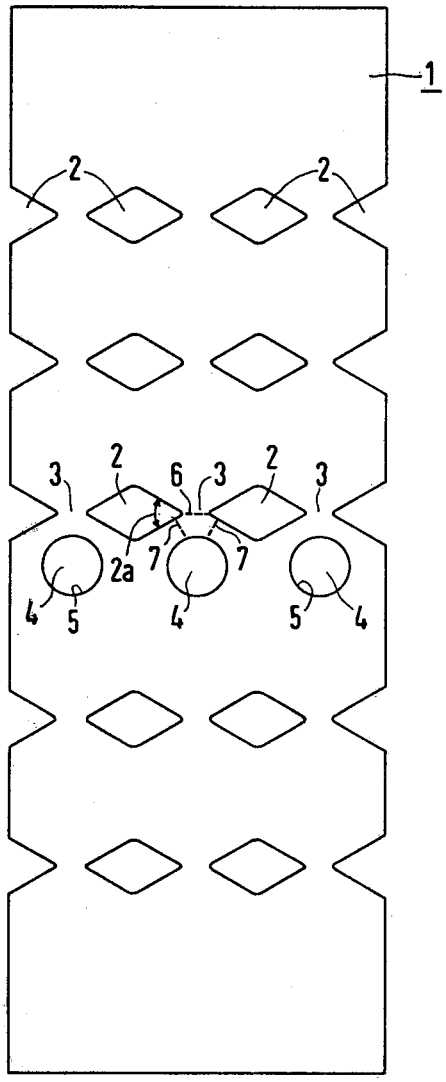
1
2
2
3
2
6
3
2
3
2a
7
7
4
5
4
5
4

ONE PIECE FUSIBLE CONDUCTOR FOR LOW VOLTAGE FUSES

BACKGROUND OF THE INVENTION

This invention relates to fuses in general and more particularly to a one piece fusible conductor for use in low voltage fuses.

Fuses of the type having cutouts for narrowing the path of the current and which have a hole containing a solder deposit near each such narrowed path or isthmus formed are known in the art. In such fusible conductors a differentiation must be made between an isthmus which carrys a current during a normal load and those isthmuses which are to open up in the case of a short circuit. Solder deposits are associated only with the isthmuses which are to respond during an overload. In such a fuse it is desired that the hottest zone to develop during an overload be as close as possible to the solder in order to let the solder flow as quickly as possible into the isthmus.

SUMMARY OF THE INVENTION

It is an object of the present invention to enhance the known measure of placing the hottest zone close to the solder in such a fusible conductor. This is done by placing the hottest zone as far as possible into the isthmus while at the same time preventing the liquid melted zone formed by the alloying of the solder from reaching only one edge defining the isthmus.

In accordance with the present invention this is accomplished by utilizing diamond shaped cutouts with at least one isthmus located between two such cutouts. The angles of the diamond shaped cutouts at which the isthmus is formed are less than 70° and more perferrably 60°. The isthmus is formed so as to have a cross section between diamond shaped cutouts with a horizontal dimension of less than or equal to one milimeter. The solder deposits are arranged in holes adjacent the isthmus and there are current carrying cross sections between the holes and the diamond shaped cutouts which are equal on both sides of the isthmus and which have a cross section with a horizontal dimension always smaller than or equal to 0.5 mm. Furthermore the relationship between the horizontal dimension of the cross section between diamond shaped cutouts and between a diamond shaped cutout and the hole is such as to approximately have the relationship $2.5 \geqq E/D \geqq 0.5$ where E is the horizontal dimension of the cross section between a hole and a diamond shaped cutout and D is the horizontal dimension of the cross section between two diamond shaped cutouts. In implementing the present invention materials normally used for fusible conductors of this nature along with solder are utilized. While retaining the starting aid for the melting zone, the hot zone is placed further into the bridge. In this manner it is insured that the liquid alloy zone can reach the center of the bridge and sever the fusible conductor at the most favorable point, at which point rapid elongation of the arc produced will occur. On the other hand, the danger of aging which occurs in conventional fuses is avoided since the alloy formation can reach the isthmus only when the fusible conductor is required to interrupt the path of the current.

BRIEF DESCRIPTION OF THE DRAWING

The single FIGURE is a schematic plan view of the fusible conductor of the present invention.

DETAILED DESCRIPTION OF THE INVENTION

On the FIGURE a one piece fusible link 1 according to the present invention is shown. The fusible link 1 has diamond shaped cutouts 2 of substantially equal cross section for narrowing the path of the current. In order to interrupt over-currents, holes 5 are formed in the vicinity of the narrow current carrying isthmuses 3 and are filled with solder deposits 4. The narrow areas or isthmus 3 are always situated between two diamond shaped cutouts 2. The angle 2*a* of these diamond shaped cutouts, at an isthmus 3 is less than 70°. An angle of 60° is particularly advantageous. The horizontal dimension D of the cross section 6 between diamond shaped cutouts is equal to or less than 1.0 mm. The holes 5 having solder deposits 4 leave a current carrying cross section 7 standing between the holes 5 and the diamond shaped cutouts 2 which have a horizontal dimension E which is smaller than or equal to 0.5 mm. The relationship between the dimension D and E should be as follows: $2.5 \geqq E/D \geqq 0.5$. Thus D can be 0.5 mm and E 0.5 mm for example.

What is claimed:

1. In a one piece fusible conductor for use in a low voltage fuse having cutouts of substantially equal cross section of the isthmus between cutouts being less than ing current carrying isthmuses, with a hole containing a solder deposit in the vicinity of each current carrying isthmus, the improvement comprising at least one isthums located between two diamond shaped cutouts, each cutout enclosing an angle at the isthmus which is less than 70°, with the horizontal dimension of the cross section of the isthums between cutouts being less than or equal to 1 mm, the holes and solder deposits therein being disposed adjacent said isthmus such as to leave equal current carrying cross sections standing between said holes and adjacent diamond shaped cutouts forming an isthums, the cross sections between said holes and said diamond shaped cutouts having a horizontal dimension which is smaller than or equal to 0.5 mm, the horizontal dimensions of said cross sections having approximately the relationship $2.5 \geqq E/D \geqq 0.5$ where E is the horizontal dimension of the cross section between said hole and one of said cutouts and D the horizontal dimension of the cross section between said cutouts.

2. The improvement according to claim 1 wherein said enclosed angle is approxiamtely 60°.

* * * * *

UNITED STATES PATENT AND TRADEMARK OFFICE

CERTIFICATE OF CORRECTION

PATENT NO. : 4 1 1 8 6 8 4

DATED : OCTOBER 3, 1978

INVENTOR(S) : KLAUS MÖLLENHOFF

It is certified that error appears in the above-identified patent and that said Letters Patent are hereby corrected as shown below:

Claim 1, Line 36: delete "of the isthmus between cutouts being less than" and insert instead: --for narrowing the path of the current and form- -- line 43: delete "isthums" and insert instead: --isthmus--

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*